US007276868B2

(12) United States Patent
Allred, III

(10) Patent No.: US 7,276,868 B2
(45) Date of Patent: Oct. 2, 2007

(54) CARBON-FIBER LAMINATE MUSICAL INSTRUMENT SOUND BOARD

(76) Inventor: Jimmie B. Allred, III, Phoenix Bldg., 2 South St., Auburn, NY (US) 13021

( * ) Notice: Subject to any disclaimer, the term of this patent is extended or adjusted under 35 U.S.C. 154(b) by 248 days.

(21) Appl. No.: 11/092,268

(22) Filed: Mar. 29, 2005

(65) Prior Publication Data

US 2005/0223871 A1 Oct. 13, 2005

Related U.S. Application Data

(60) Provisional application No. 60/557,185, filed on Mar. 29, 2004.

(51) Int. Cl.
*G10D 3/02* (2006.01)
*G10C 3/04* (2006.01)

(52) U.S. Cl. ..... 318/294; 84/184; 84/187; 84/192; 84/265; 84/275; 84/291

(58) Field of Classification Search ..... 84/184, 84/187, 192, 265, 275, 284, 291, 294; 442/172
See application file for complete search history.

(56) References Cited

U.S. PATENT DOCUMENTS

| | | | | | |
|---|---|---|---|---|---|
| 3,477,330 | A | * | 11/1969 | Bert | 84/193 |
| 3,699,836 | A | * | 10/1972 | Glasser | 84/291 |
| 3,724,312 | A | * | 4/1973 | Yamada et al. | 84/193 |
| 3,880,040 | A | | 4/1975 | Kaman | 84/291 |
| 4,334,452 | A | | 6/1982 | Morrison, III et al. | 84/723 |
| 4,348,933 | A | | 9/1982 | Kaman et al. | 84/193 |
| 4,353,862 | A | | 10/1982 | Kaman, II | 264/571 |
| 4,364,990 | A | * | 12/1982 | Haines | 428/218 |
| 4,873,907 | A | | 10/1989 | Decker, Jr. et al. | 84/291 |
| 4,942,013 | A | * | 7/1990 | Palmer et al. | 264/511 |
| 4,969,381 | A | | 11/1990 | Decker, Jr. et al. | 84/291 |
| 5,125,312 | A | | 6/1992 | Fishman et al. | 84/291 |
| 5,189,235 | A | | 2/1993 | Fishman et al. | 84/291 |
| 5,333,527 | A | * | 8/1994 | Janes et al. | 84/291 |
| 5,469,769 | A | | 11/1995 | Sawada | 84/193 |
| 5,879,492 | A | * | 3/1999 | Reis et al. | 156/72 |
| 5,952,592 | A | | 9/1999 | Tell | 84/291 |
| 6,087,568 | A | | 7/2000 | Seal | 84/193 |
| 6,107,552 | A | * | 8/2000 | Coomar et al. | 84/291 |
| 6,117,376 | A | * | 9/2000 | Merkel | 264/46.5 |
| 6,294,718 | B1 | * | 9/2001 | Saunders et al. | 84/291 |
| 6,333,280 | B1 | * | 12/2001 | Hashimoto et al. | 442/70 |
| 6,372,970 | B1 | | 4/2002 | Saunders et al. | 84/293 |
| 6,610,915 | B2 | * | 8/2003 | Schleske | 84/291 |
| 6,664,452 | B1 | * | 12/2003 | Teel | 84/291 |
| 6,676,882 | B2 | * | 1/2004 | Benson et al. | 264/510 |
| 6,683,236 | B2 | * | 1/2004 | Davis et al. | 84/291 |
| 6,696,627 | B2 | * | 2/2004 | Florath et al. | 84/290 |
| 6,737,568 | B2 | * | 5/2004 | Schleske | 84/291 |
| 6,770,804 | B2 | * | 8/2004 | Schleske | 84/290 |

(Continued)

*Primary Examiner*—Lincoln Donovan
*Assistant Examiner*—Robert W. Horn
(74) *Attorney, Agent, or Firm*—Brown & Michaels, PC

(57) ABSTRACT

A soundboard for a hollow-body stringed instrument made of layers of carbon-fiber and resin material surrounding a core of one or more layers of constant-thickness plywood, veneer (thinly sliced wood) or paper. Additional shaped layers are provided to produce a desired pattern of stiffness in the soundboard. The soundboard may be tuned by attaching additional masses to a surface of the soundboard. A method of making and tuning the soundboard of the invention is provided.

16 Claims, 4 Drawing Sheets

U.S. PATENT DOCUMENTS

| | | | | |
|---|---|---|---|---|
| 6,774,292 | B2 * | 8/2004 | Mace | 84/293 |
| 7,081,576 | B1 * | 7/2006 | Daoud | 84/411 R |
| 7,208,665 | B2 * | 4/2007 | Schleske | 84/275 |
| 2002/0066353 | A1 | 6/2002 | Schleske | 84/291 |
| 2002/0066354 | A1 | 6/2002 | Schleske | 84/291 |
| 2002/0069743 | A1 * | 6/2002 | Schleske | 84/291 |
| 2002/0104423 | A1 | 8/2002 | Verd | 84/291 |
| 2002/0149134 | A1 * | 10/2002 | Hemphill et al. | 264/255 |
| 2002/0174760 | A1 * | 11/2002 | Mace | 84/293 |
| 2004/0046291 | A1 * | 3/2004 | Johnson et al. | 264/510 |
| 2004/0060414 | A1 | 4/2004 | Janes et al. | 84/291 |
| 2004/0247801 | A1 * | 12/2004 | Schober | 428/13 |
| 2005/0223871 | A1 * | 10/2005 | Allred, III | 84/294 |
| 2005/0227560 | A1 * | 10/2005 | Allred, III | 442/172 |
| 2006/0042448 | A1 * | 3/2006 | Schleske | 84/275 |
| 2006/0147655 | A1 * | 7/2006 | Schober | 428/13 |
| 2006/0246796 | A1 * | 11/2006 | Duffy | 442/38 |

* cited by examiner

Fig. 9

91. Wet the carbon fiber material forming the "face" layer

92. Lay the epoxy wetted material on a surface of glass;

93. Place the perforated core material over the wetted carbon fiber face layer;

94. Place shaped additional layers of material on the core material

95. If desired, place stiffeners on the core material

96. Wet the carbon fiber material forming the "back" layer;

97. Place the back layer of epoxy wetted carbon fiber over the core material and additional layers (and stiffeners, if any);

98. Apply a layer of peel-ply and/or release-ply over the back layer;

99. Place a "breather" layer over the back layer;

100. Encase all of the layers in an airtight plastic bag.

101. Evacuate the air from the bag and allow the epoxy to cure;

102. Remove the bag;

103. Separate the glass and the peel-ply, release-ply and breather layers from the finished laminated sound board;

104. If desired, attach stiffeners over the back layer.

105. Assembling the sound board into the instrument

106. Tuning the sound board by attaching masses to the surface of the sound board

CARBON-FIBER LAMINATE MUSICAL INSTRUMENT SOUND BOARD

REFERENCE TO RELATED APPLICATIONS

This application claims an invention which was disclosed in Provisional Application No. 60/557,185, filed Mar. 29, 2004, entitled "Carbon-Fiber Laminates, Methods of Making Carbon-Fiber Laminates, and Products Made of Carbon-Fiber Laminates". The benefit under 35 USC § 119(e) of the United States provisional application is hereby claimed, and the aforementioned application is hereby incorporated herein by reference.

BACKGROUND OF THE INVENTION

1. Field of the Invention

The invention pertains to the field of carbon-fiber laminates. More particularly, the invention pertains to musical instrument sound boards made of layers of carbon-fiber and resin with a core or base layer of specific material, and methods of making such sound boards.

2. Description of Related Art

The following US patents and published applications show stringed instruments with soundboards incorporating composite fiber materials:

U.S. Pat. No. 3,880,040 "Sound Board for Stringed Instrument" Kaman (1975) Guitar having a sound board made of layers of graphite fiber and a wood core. Core is plywood or veneer, may be single layer or multiple layers.

U.S. Pat. No. 4,334,452 "Plastic musical instrument body having structural insert" Morrison, et al [Norlin Industries, Inc.](1982)—a structural support member of wood is embedded within a plastic body, which is essentially solid (there is a cut-out hollow area). The thickness of plastic about the structural member at most points along the member is substantially minimized and the mass of plastic material on one side of the member is not substantially greater than the mass of plastic on the opposite side of the member.

U.S. Pat. No. 4,348,933 "Soundboard assembly for pianos or the like" Kaman, et al. [Currier Piano Company, Inc.] (1982) A soundboard assembly for use in a piano, harpsichord or similar stringed musical instrument comprises a thin, laminated soundboard consisting of a center sheet of wood and two outer layers of composite material. The center wooden sheet has a substantially unidirectional grain and the two outer layers of composite material are made of unidirectional carbon fibers embedded in a resin matrix.

U.S. Pat. No. 4,353,862 "Method for making sound board" Kaman [Kaman Aerospace Corporation](1982)—A fiber glass fabric reinforced wood sound board for a guitar is made by placing a sheet of wood in a shallow mold cavity with a layer of fiber glass fabric overlying an associated surface of the wood sheet, spreading a layer of liquid resinous compound over the layer of fabric to impregnate the fabric, providing a plate having a smooth surface, positioning the plate with its smooth surface in face-to-face engagement with the layer of liquid impregnating material to provide a substantial closure for the mold cavity, drawing vacuum on the mold cavity, and curing the liquid resinous material.

U.S. Pat. No. 4,364,990 "Construction material for stringed musical instruments" Haines [University of South Carolina] (1982)—Uses cardboard or paper core covered in carbon-fiber material.

U.S. Pat. Nos. 4,873,907 and 4,969,381 "omposite-materials acoustic stringed musical instrument" Decker, Jr. et al. [Kuau Technology, Ltd.] (1989/1990)—soundboard for an acoustic guitar made of a composite-materials plate having an area density matching that of wooden soundboards while having a bulk density exceeding the bulk density of wooden soundboards. The soundboard is preferably made of a lay-up of woven polymer (preferably aramid) fabric and a layer of unidirectional graphite fibers followed by a layer of decorative fabric (e.g., silk), all embedded in a resin matrix.

U.S. Pat. Nos. 5,125,312 and 5,189,235 "Stringed Musical Instrument" Fishman, et al [Korg/Fishpark Associates] (1992/1993) A light weight guitar with light weight wood core material, strengthening layer of carbon fiber and a fiberglass sheet layer both impregnated with a high temperature resin. This is a solid-body guitar, the wood core is 1.5 inches thick.

U.S. Pat. No. 5,469,769 "Soundboard for musical instruments" Sawada et al. [Yamaha Corporation] (Nov. 28, 1995)—laminated construction soundboard for use pianos, the core having larger shearing elastic modulus and/or smaller shearing loss tangent than that of the fore and rear plates.

U.S. Pat. No. 5,952,592 "Acoustic guitar assembly" Teel (1999) An acoustic guitar having a resin laminate soundboard with a bracing pattern specifically configured to provide the non-wooden soundboard with qualities resembling traditional wooden soundboards.

U.S. Pat. No. 6,087,568 "Acoustically tailored composite material stringed instrument" Seal (Jul. 11, 2000)—guitar made up of a plurality of plies of composite laminates individually selected and arranged together to provide desired sounds.

U.S. Pat. No. 6,107,552 "Soundboards and stringed instruments" Coomar, et al.[Kuau Technology, Ltd.] (2000)—Soundboard includes first and second opposed layers of a stiffened graphite sheet material and a low-density foam core material interposed between the first and second opposed layers.

U.S. Pat. No. 6,294,718 "Stringed musical instrument top member" Saunders, et al. [Kaman Music Corporation] (2001)—Soundboard includes an outer composite material layer and an inner composite layer with a core layer, preferably wood, bonded between the inner and outer layers. Referring to FIG. 5, the composite material layers extend outboardly from the outer periphery of the interior portion and are bonded in contact with each other to form the core free flex edge portion of the forward part.

U.S. Pat. No. 6,372,970 Stringed musical instrument body and neck assembly Saunders, et al [Kaman Music Corporation] (2002)—Sound board has an outer composite material layer and an inner composite layer with a core layer, preferably wood, bonded between the inner and outer layers.

U.S. Pat. No. 6,664,452 "Acoustic guitar having a composite soundboard" Teel [C. F. Martin & Company, Inc.] (2003)—acoustic guitar having a hollow body constructed with a pre-finished graphite soundboard and a pre-finished high pressure laminate backboard and sidewall. A bracing pattern particularly for use with the graphite soundboard is also provided.

Published Application No. 2004/60,417 "Solid body acoustic guitar" Janes, et al. (Apr. 1, 2004)—A guitar body is formed of a generally solid material having a cavity formed therein and substantially lacking a soundboard. A soundboard is formed of a generally planar material attached to the solid material, so as to substantially cover the cavity. The planar material can be composite graphite.

Published Application No. 2002/104,423 "Composite stringed musical instrument, and method of making the same" Verd (Aug. 8, 2002)—acoustic and electrically amplified stringed musical instruments comprising fiber-reinforced resin composite materials, where the instruments are provided with a sound-damping interior coating.

Published Application No. 2002/69,743 "Soundboard of composite fibre material construction" Schleske (Jun. 13, 2002)—a soundboard for acoustic musical instruments constructed as a composite fiber sandwich plate consisting of core plate and fiber coating. The fiber coating is characterized in that it is multidirectional and single-layer, or multidirectional and applied only to part-zones of the core plate.

Published Application No. 2002/66,354 "Soundboard of composite fibre material construction" Schleske (Jun. 6, 2002)—a soundboard for acoustic musical instruments produced as a composite fiber sandwich. The core plate of the sandwich construction is provided with at least one recess.

Published Application No. 2002/66,353 "Soundboard of composite fibre material construction" Schleske (Jun. 6, 2002)—a soundboard for acoustic musical instruments constructed as a composite fiber sandwich plate. The area defined by the outline of the soundboard is enlarged relative to the average area of the soundboards of conventional musical instruments of the same type in such a way as to compensate for the characteristic frequency shifts ( and thus changes in timbre) which result from the more favorable ratio of stiffness to mass of the composite fiber sandwich plate relative to the conventional solid wood soundboard.

SUMMARY OF THE INVENTION

The invention comprises a sounding plate or board for a hollow-body stringed instrument made of layers of carbon-fiber and resin material surrounding a core of one or more layers of constant-thickness plywood, veneer (thinly sliced wood) or paper. Additional shaped layers are provided to produce a desired pattern of stiffness in the soundboard.

The soundboard may be tuned by attaching additional masses to a surface of the soundboard.

A method of making and tuning the soundboard of the invention is provided in the detailed description of the invention, below.

BRIEF DESCRIPTION OF THE DRAWING

FIG. 9 shows a flowchart of a method of making the soundboard of the invention

DETAILED DESCRIPTION OF THE INVENTION

Figure 1:
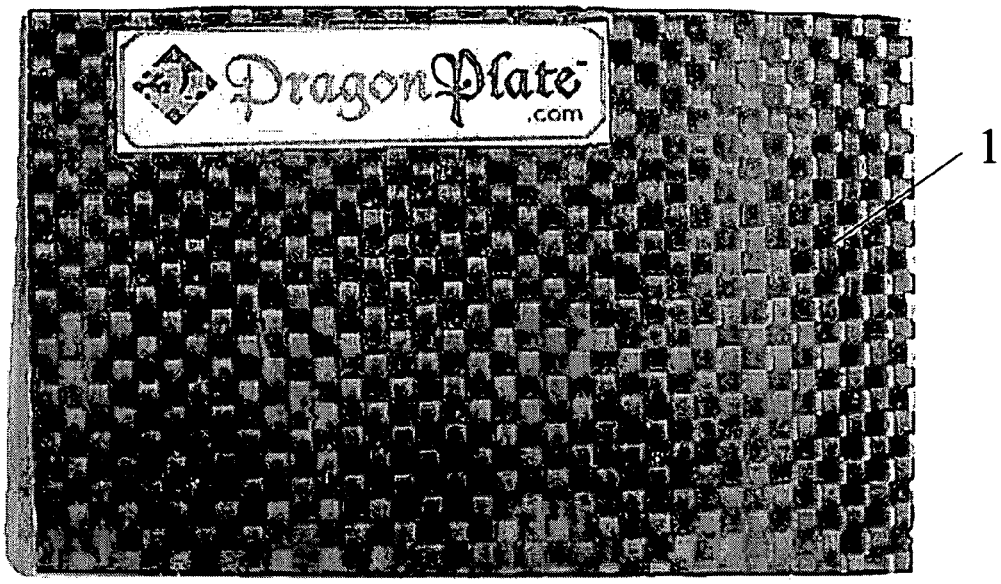
FIG. 1 shows a sheet of an embodiment of the laminate material of the invention having a wood core.
Figure 2:
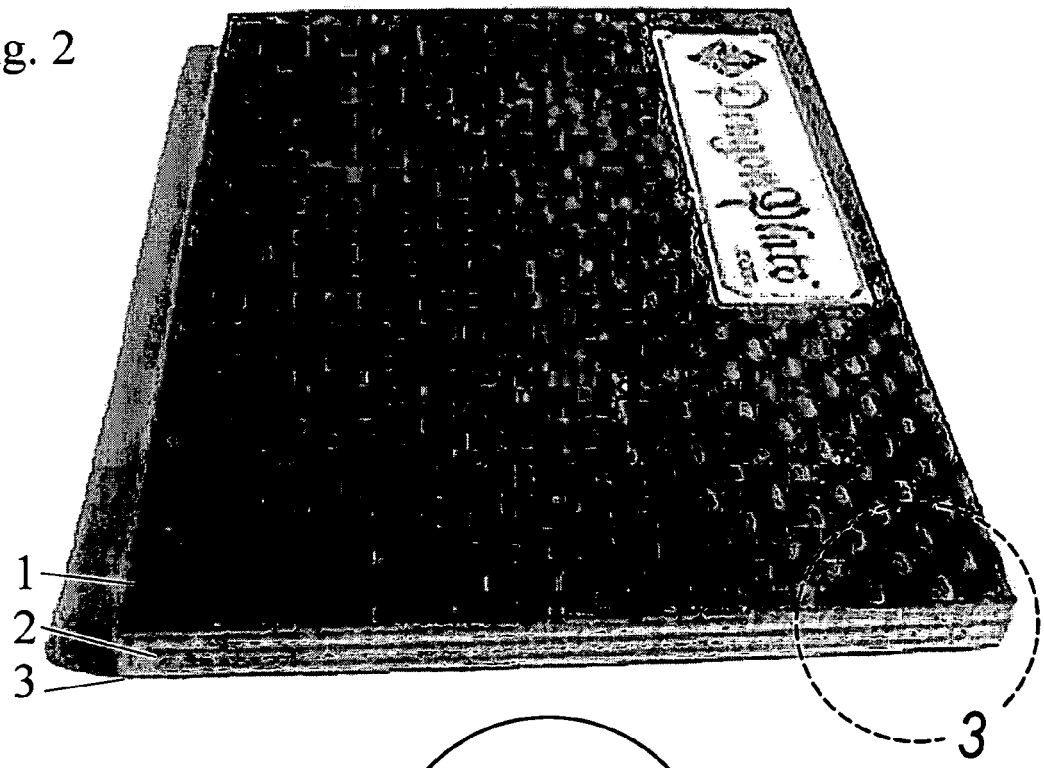
FIG. 2 shows a perspective view of the laminate material of the invention of FIG. 1.
Figure 3:
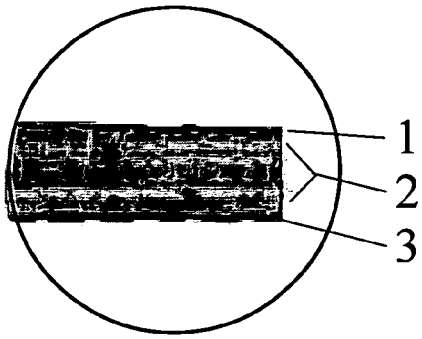
FIG. 3 shows a detail of the structure of the material of FIGS. 1 and 2, enclosed in circle 3 in FIG. 2.

FIGS. 1 through 3 show a sheet of an embodiment of the laminate material used in the sound board of the invention. The laminate material in this embodiment comprises two layers of carbon-fiber material (1) and (3), surrounding a core of wood material (2). The resulting laminate material is lightweight, yet has a very high strength-to-weight ratio allowing fabrication of very stiff and stable structures.

This versatile material is easy to cut, drill, glue and finish using the most basic tools. The carbon-fiber layers can be finished to a high-gloss, deep and beautiful appearance, making the material ideal for use in applications where appearance is a factor, such as the instrument sound board of the present invention. If desired, one of the carbon-fiber layers can be given a rough finish, to improve adhesion for bonding to other materials using epoxy adhesive or the like.

The strength, light weight, and attractive appearance of carbon fiber laminate material makes it a desirable material for the making of sound boards for hollow-bodied stringed musical instruments.

Figure 6:
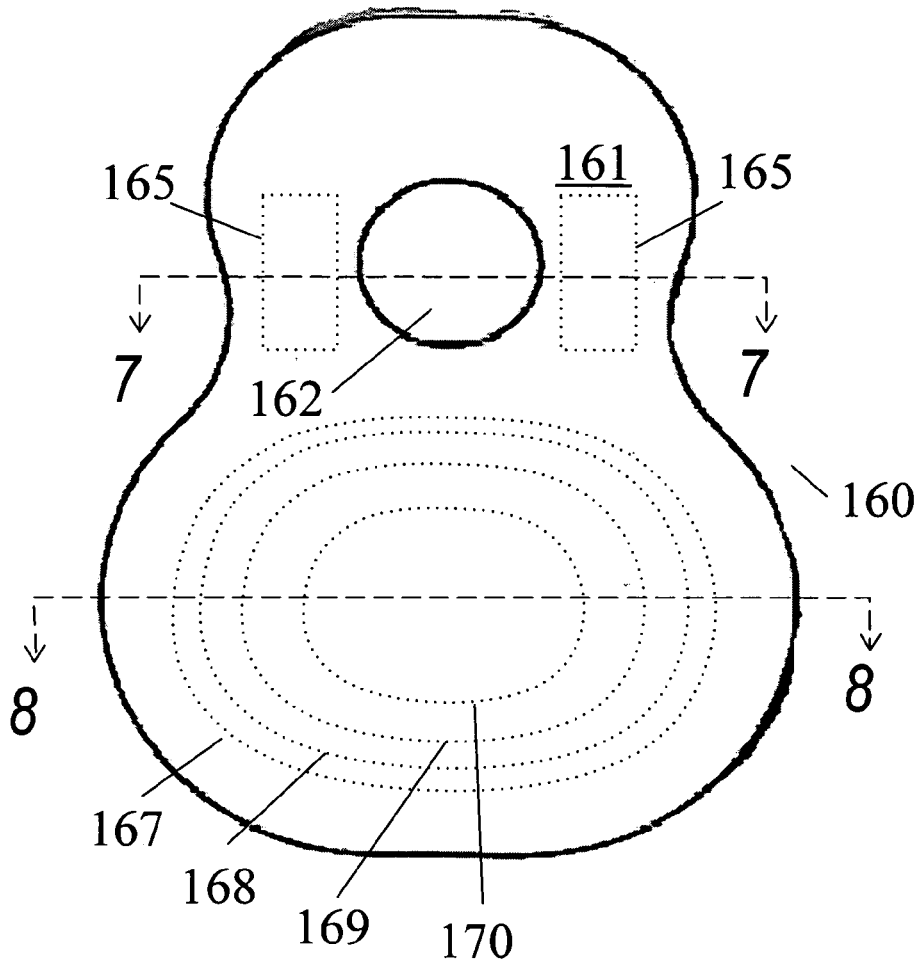
FIG. 6 shows a laminate sound board embodiment of the invention.
Figure 7:
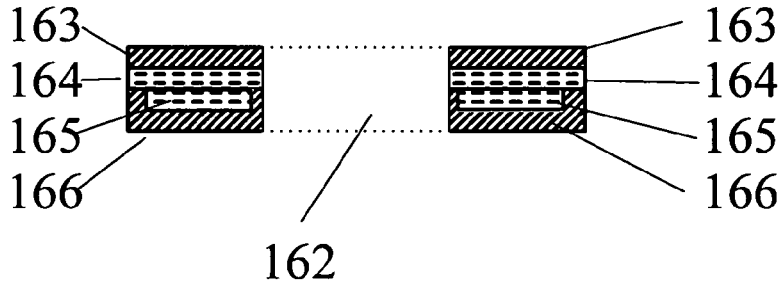
FIG. 7 shows a cross-section view of the sound board of FIG. 6, along the lines 7-7 in FIG. 6.
Figure 8:
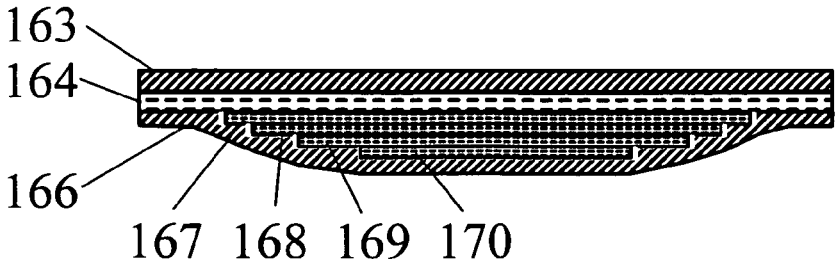
FIG. 8 shows a cross-section view of the sound board of FIG. 6, along the lines 8-8 in FIG. 7.

FIG. 6 shows a laminate sound board embodiment of the invention, shown here as it might be used in a guitar (160). FIGS. 7 and 8 show cross-section views of the sound board of FIG. 6, along the lines 7-7 and 8-8 in FIG. 6.

As can be seen in the figures, the laminated sound board (161) of the invention uses layers of carbon fiber material (163) and (166) surrounding one or more constant-thickness layers of wood or paper (164) and (165). A sound hole (162) may be provided, as is conventional for such instruments.

Carbon fiber layers (163) and (166) may be made from commercially available pre-impregnated ("prepreg") sheets—unidirectional or multidirectional carbon fibers in a curable epoxy resin matrix, or from one or more layers of dry carbon fiber fabric or fiber wetted with liquid epoxy.

Figure 4:
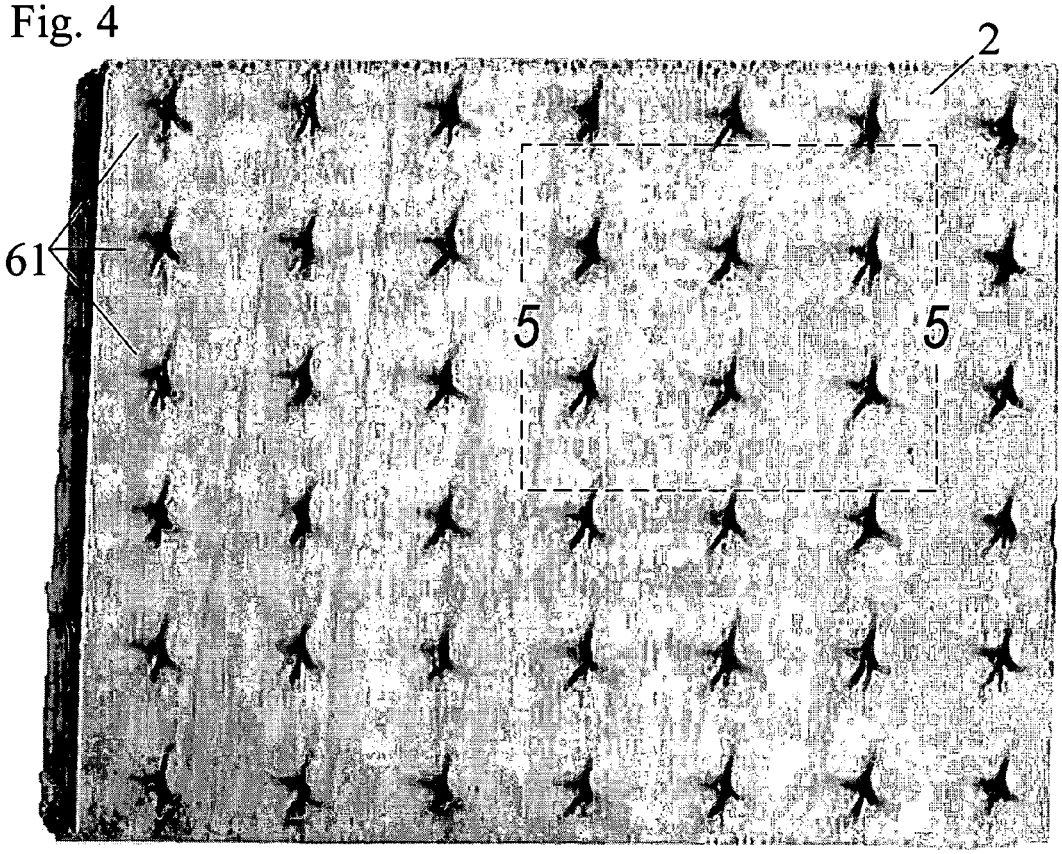
FIG. 4 shows a piece of plywood core material as used in the embodiment of FIG. 1.
Figure 5:
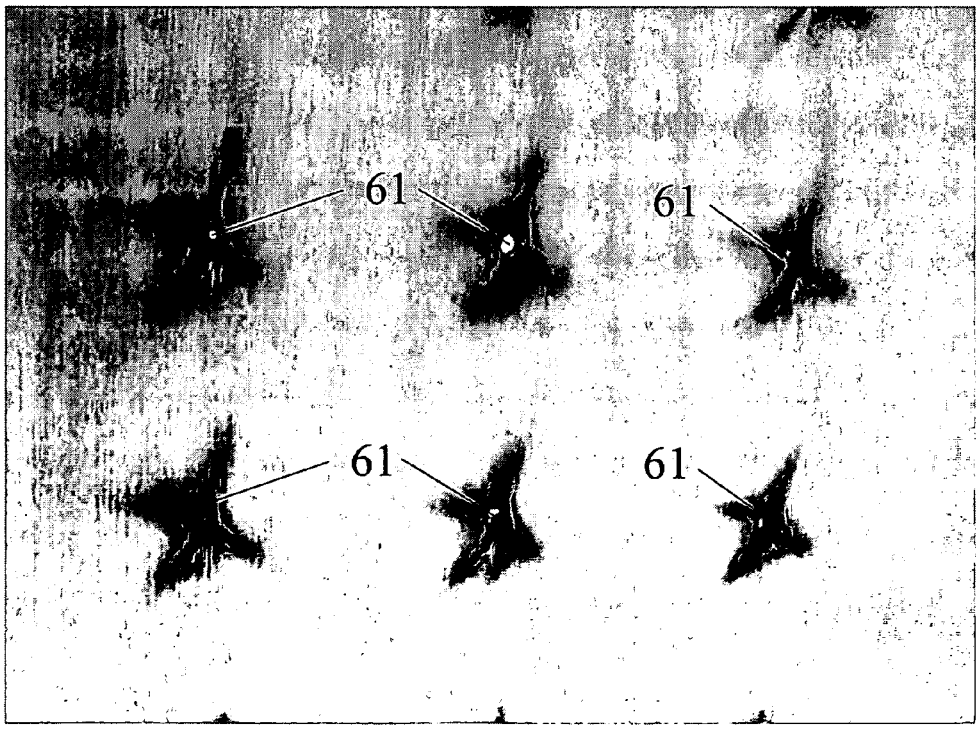
FIG. 5 shows a closeup of the core material of FIG. 4, enclosed in lines "5" in that figure.

Preferably, the wood material is a thin plywood, although if a thinner laminate material is needed, a sheet of veneer (thinly sliced wood) or paper such as Kraft paper can be used. As shown in FIGS. 4 and 5, the wood core material (164)(165)(167) as used in this embodiment of the invention is perforated with an array of holes (61) through the thickness of the core material (2).

This permits the resin in the carbon-fiber to penetrate into the core and grip the layers together tightly. The perforations are made by water jet or laser, as shown in FIGS. 4 and 5, which creates an accurate grid of holes (61) without the need to remove mechanical burrs and other imperfections which could be caused by drilling.

The sound board (161) can be shaped and tuned by the selection of the thickness of the core layer (164), and a desired stiffness is created across the board by adding additional shaped layers (167)-(170) of constant-thickness material within the laminated sound board to increase the thickness of the resulting laminate in local areas. The shaped layers may be made of thin wood veneers, plywood or paper such as Kraft paper, and can be cut with a steel-rule die, or lasers, or routers, or scissors. Viewed from above, the layers of core material inside the carbon-fiber layers form the contours of the sound board in the same way that the "contour lines" of a topographical map delineate contour changes on the earth.

Stiffeners or braces (165) may also be added.

Once the laminated structure of the soundboard is laid-up and cured, it may be tuned by attaching added masses to the inner or outer surface of the board.

The sound board (161) may be made by the following method (see FIG. 9):

91. Wet the carbon fiber material forming the "face" layer (163) with epoxy resin;
92. Lay the epoxy wetted material on a smooth surface, preferably of glass;
93. Place the perforated core material (164) over the wetted carbon fiber face layer (1);
94. Place shaped additional layers (167)-(170) of perforated core material on the core material (164), to provide desired stiffness by building up a graduated thickness of the core in selected positions;
95. If desired, place stiffeners or braces (165) on the core material (164)—note that stiffeners or braces may also be added over the back layer (166) after curing;
96. Wet the carbon fiber material forming the "back" layer;
97. Place the back layer of epoxy wetted carbon fiber (166) over the core material and additional layers (and stiffeners, if any);
98. Apply a layer of peel-ply and/or release-ply over the back layer;
99. Place a "breather" layer over the back layer;
100. Encase all of the layers in an airtight plastic bag.
101. Evacuate the air from the bag and allow the epoxy to cure;
102. Remove the bag;
103. Separate the glass and the peel-ply, release-ply and breather layers from the finished laminated sound board;
104. If desired, attach stiffeners or braces (165) over the back layer (166).

After producing the sound board it may be tuned by the further steps of:

105. Assembling the sound board into the instrument; and
106. Tuning the sound board by attaching masses to the surface of the sound board at determined positions to accomplish the desired tuning.

This last step (106) may be done by temporarily gluing the masses to the outside of the sound board until the tuning is complete, then removing the sound board, moving the masses to the same locations on the inside surface of the sound board, gluing the masses in place and replacing the soundboard on the instrument.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

I claim:

1. Is allowable over the prior art for a method of making a musical instrument soundboard from carbon-fiber laminate material comprising the steps of:

a) providing at least one layer of carbon fiber material with epoxy resin, for forming a face layer;
b) laying the epoxy wetted material on a smooth surface;
c) placing a core material over the wetted carbon fiber face layer (1);
d) placing shaped additional layers of material on the core material, to provide desired stiffness by building up a graduated thickness of the core in selected positions;
e) wetting carbon fiber material forming a back layer;
f) placing the back layer of epoxy wetted carbon fiber over the core material and additional layers;
g) applying a layer of peel-ply and/or release-ply-over the back layer;
h) placing a "breather" layer over the back layer;
i) encasing all of the layers in an airtight plastic bag;
j) evacuating the air from the bag;
k) allowing the epoxy to cure;
l) removing the bag; and
m) separating the smooth surface and the peel-ply, release-ply and breather layers from the finished laminated sound board.

2. The method of claim 1, in which the core material is plywood.

3. The method of claim 1, in which the core material is wood veneer.

4. The method of claim 1, in which the core material is paper.

5. The method of claim 4, in which the paper is kraft paper.

6. The method of claim 1, in which the core material is perforated.

7. The method of claim 1, in which the shaped layer material is plywood.

8. The method of claim 1, in which the shaped layer material is wood veneer.

9. The method of claim 1, in which the shaped layer material is paper.

10. The method of claim 9, in which the paper is kraft paper.

11. The method of claim 1, in which step (a) further comprises the step of wetting a layer of carbon fiber with a liquid epoxy resin.

12. The method of claim 1, in which the carbon fiber material provided in step (a) is pre-impregnated sheets of unidirectional or multidirectional carbon fibers in a curable epoxy resin matrix.

13. The method of claim 1, further comprising the step, between steps (d) and (e), of placing stiffeners on the core material.

14. The method of claim 1, further comprising the step, after step (m) of fastening stiffeners over the back layer.

15. The method of claim 1, further comprising the step, after step (m), of n) assembling the sound board into the instrument; and
o) tuning the sound board by attaching masses to a surface of the sound board at determined positions to accomplish the desired tuning.

16. The method of claim 15, in which step (o) comprises the steps of i) temporarily gluing the masses to the outside of the sound board until the tuning is complete;
ii) removing the sound board;
iii) moving the masses to the same locations on the inside surface of the sound board
iv) gluing the masses in place; and
v) replacing the soundboard on the instrument.

* * * * *

UNITED STATES PATENT AND TRADEMARK OFFICE

CERTIFICATE OF CORRECTION

PATENT NO. : 7,276,868 B2
APPLICATION NO. : 11/092268
DATED : October 2, 2007
INVENTOR(S) : Jammie B. Allred, III It is certified that error appears in the above-identified patent and that said Letters Patent is hereby corrected as shown below:

Claim 1, (Column 5, line 52): Delete the words "Is allowable over the prior art".

Signed and Sealed this

Eighteenth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,276,868 B2
APPLICATION NO. : 11/092268
DATED : October 2, 2007
INVENTOR(S) : Jammie B. Allred, III It is certified that error appears in the above-identified patent and that said Letters Patent is hereby corrected as shown below:

Claim 1, (Column 5, line 52): Delete the words "Is allowable over the prior art".

Signed and Sealed this

Twenty-fifth Day of March, 2008

JON W. DUDAS
*Director of the United States Patent and Trademark Office*